US006739921B2

(12) United States Patent
Nakajima et al.

(10) Patent No.: US 6,739,921 B2
(45) Date of Patent: May 25, 2004

(54) EXHAUST STRUCTURE OF EXHAUST SYSTEM FOR A BOAT

(75) Inventors: Jun Nakajima, Saitama (JP); Takayoshi Miura, Saitama (JP); Noboru Yokoya, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/231,138

(22) Filed: Aug. 30, 2002

(65) Prior Publication Data

US 2003/0060099 A1 Mar. 27, 2003

(30) Foreign Application Priority Data

Sep. 5, 2001 (JP) ..... 2001-269463

(51) Int. Cl.[7] ..... B63H 21/32
(52) U.S. Cl. ..... 440/89 F; 440/89 J
(58) Field of Search ..... 440/89 R, 89 B, 440/89 C, 89 E, 89 F, 89 J

(56) References Cited

U.S. PATENT DOCUMENTS 5,048,287 A * 9/1991 Howe et al. ..... 60/288
5,168,132 A * 12/1992 Beidl et al. ..... 181/265
5,464,357 A * 11/1995 Craig et al. ..... 440/89 R

FOREIGN PATENT DOCUMENTS

JP 10-212936 8/1998

* cited by examiner

*Primary Examiner*—Stephen Avila
(74) *Attorney, Agent, or Firm*—Birch, Stewart, Kolasch & Birch, LLP

(57) ABSTRACT

An exhaust system for a small boat is constructed in such a manner that an exhaust pipe extends rearwardly from an engine provided in a hull of the boat. A water muffler is provided in the exhaust pipe, and exhaust gas is discharged through a water lock pipe extending upward from a water muffler. A water lock pipe has an inverted U-shape. A resonator chamber for attenuating resonance of the water lock pipe is provided in the water muffler. The resulting configuration provides an effective system for reducing exhaust noise emanating from the small boat.

18 Claims, 8 Drawing Sheets

BACKGROUND ART

EXHAUST STRUCTURE OF EXHAUST SYSTEM FOR A BOAT

CROSS-REFERENCE TO RELATED APPLICATION

The present application claims priority under 35 U.S.C. §119 to Japanese Patent Application No. 2001-269463 filed on Sep. 5, 2001, the entire contents of which are hereby incorporated by reference.

BACKGROUND OF THE INVENTION

1. Field of the Invention

The present invention relates to an exhaust system for an engine mounted on a small boat, for example, a boat propelled by jet water from a jet pump.

2. Description of Background Art

A jet propulsion boat is a vessel provided with a jet pump mounted at the rear portion of the hull. An engine drives the jet pump to propel the boat by drawing in water from the vessel bottom, and then splashing the water in a rearward direction.

The jet propulsion boat disclosed, for example, in Japanese Patent Laid-Open No. 212936/1998, entitled "EXHAUST SYSTEM FOR A SMALL PLANING BOAT", is known. This jet propulsion boat comprises a water muffler disposed midway in the exhaust pipe. FIG. 3 of this patent has been reproduced herein as FIG. 8.

FIG. 8 is a cross sectional view showing the water muffler of the above described related art.

Cooling water used for cooling exhaust gas flows from the insert port 101 of the water muffler 100 into the second chamber 103, as shown by the arrow (a). Then, the cooling water flows from the second chamber 103 flows via the first chamber 102 into the third chamber 104.

On the other hand, exhaust gas discharged from the engine flows from the internal tube 105 of the water muffler 100 into the first chamber 102, as shown by the arrow (b). Exhaust gas from the first chamber 102 flows through a communication cylinder 106 to the second chamber 103, and thereafter, flows through the communication cylinder 107 and into the third chamber 104.

Lastly, the exhaust gas in the third chamber 104, as well as the cooling water which has been trapped in the third chamber 104, flow together out through the exhaust pipe 108.

With this water muffler 100, it is possible to lower exhaust noise to a certain level by flowing exhaust gas into the expansion chambers of the first to third chambers and expanding exhaust gas therein. However, it is difficult to sufficiently eliminate the noise merely by the expansion of gas. Thus, an exhaust system having a sound-deadening resonator disposed in the exhaust pipe has been proposed in order to further lower the noise. Exhaust noise can be lowered by resonating with the resonator.

However, in order to provide a resonator in the exhaust pipe, it is necessary to secure a storing space for storing the resonator in the hull. The interior of the hull of most small boats is limited in size. Thus, in addition to planning for the space required for storing the resonator, consideration must be given to laying out the variety of accessories that also must be mounted in the hull of the vessel. Finding storage space in the hull for all of the required components, in addition to a resonator, has proved to be difficult.

SUMMARY AND OBJECTS OF THE INVENTION

Accordingly, it is an object of the present invention to provide an exhaust system for a small boat that can be stored in a practical manner, which at the same time can achieve the desired reduction in noise.

In order to solve this problem, a first aspect of the present invention provides a small boat in which an exhaust pipe extends rearwardly from the engine provided in the hull. A water muffler is disposed in the exhaust pipe, and exhaust gas is discharged through the water lock pipe in the inverted U-shape extending upward from the water muffler. Further, a resonator chamber for attenuating the resonance of a water lock pipe is provided in the water muffler.

The resonator chamber here refers to a sound box for attenuating resonance of the water lock pipe by utilizing the principle of resonance.

Since the resonator chamber for attenuating resonance of the water lock pipe is provided in the water muffler, it is not necessary to secure a separate storage space for a resonator in the limited space in the hull.

Therefore, the layout of the various accessories required for a vessel can be determined relatively easily.

In addition, by forming the resonator chamber by using a water muffler, the number of the members for constituting the resonator can be reduced. Thus, the resonator can easily be provided, and its cost can be reduced.

In a second aspect of the present invention, an expansion chamber is provided in the water muffler. Further, the extension chamber and the resonator chamber are able to communicate with each other by a communication pipe, the communication pipe being disposed above the level of the cooling water in the water muffler.

The communication pipe which enables the expansion chamber and the resonator chamber to communicate is disposed above the water level in the water muffler. Therefore, since the communication pipe is not closed by cooling water, the expansion chamber and the resonator chamber can freely communicate with each other at all times. Since characteristics of the resonator chamber are maintained, the resonance of the water lock pipe can be attenuated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Though the present invention relates to a small boat, a jet propulsion boat will be described as an example.

Figure 1:
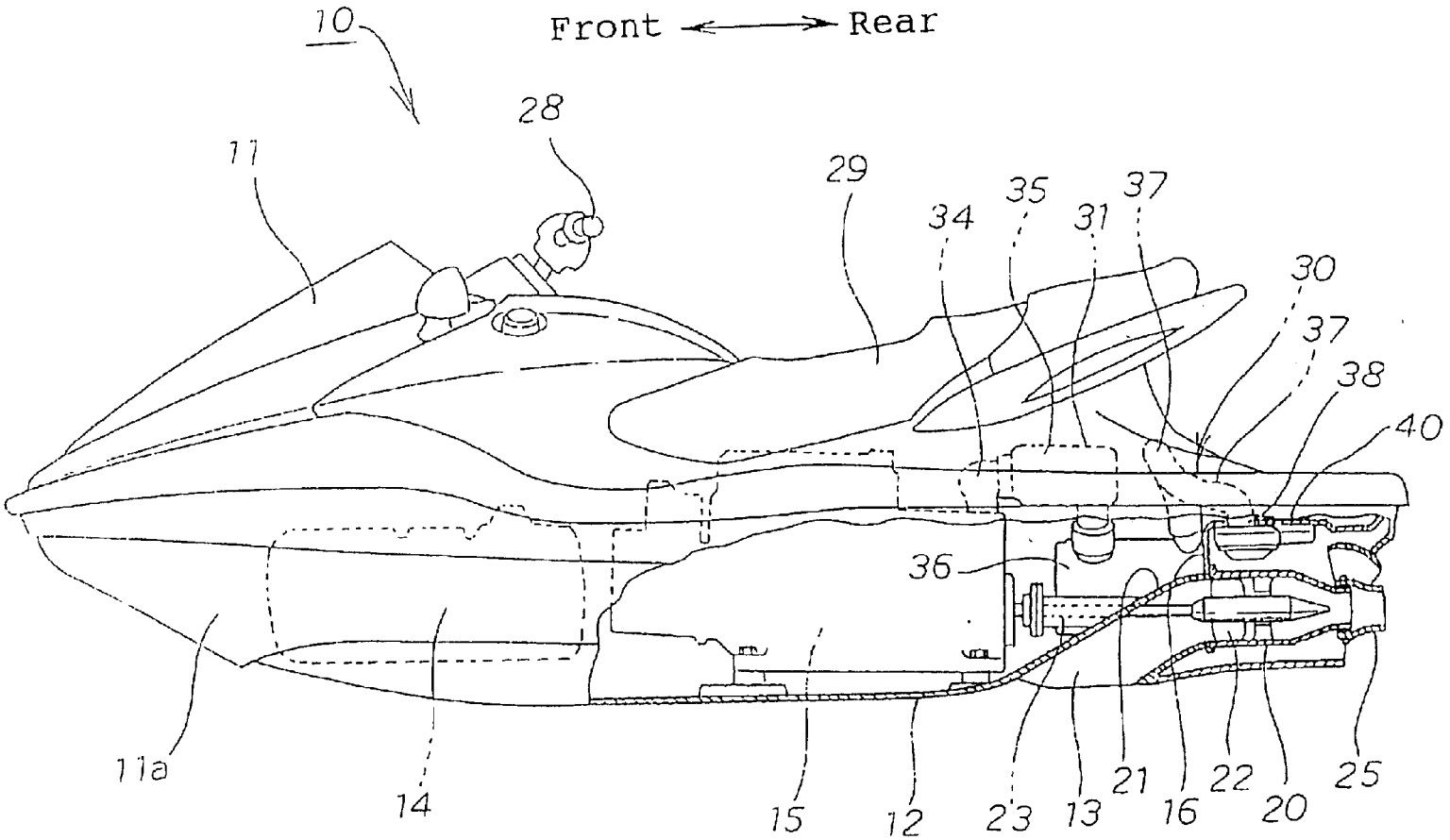
FIG. 1 is a side view of a small boat provided with an exhaust structure according to the present invention.

FIG. 1 is a side view of a small boat comprising an exhaust structure according to the present invention.

The jet propulsion boat 10 comprises a fuel tank 14 mounted at the front portion 11*a* of the hull 11, an engine 15 provided rearwardly of the fuel tank 14, a pump chamber 16 provided rearwardly of the engine 15, and a jet pump 20 provided in the pump chamber 16. An exhaust system 30 for a small boat is attached to the engine 15 on the air intake side and to the pump chamber 16 on the exhaust side, a steering handle 28 is mounted above the fuel tank 14, and a seat 29 is mounted rearwardly of the steering handle 28.

The jet pump 20 comprises a housing 21 extending rearwardly from the opening 13 of the vessel bottom 12, and an impeller 22 rotatably mounted in the housing 21 and connected to the drive shaft 23 of the engine 15.

With the jet pump 20, water drawn in through the opening 13 of the vessel bottom 12 can be splashed via the rear end opening of the housing 21 from the steering pipe (steering nozzle) 25 by driving the engine 15 and rotating the impeller 22.

The steering pipe (steering nozzle) 25 is a member mounted at the rear end of the housing 21 so as to be capable of swinging in the lateral direction. The steering nozzle 25 is a steering nozzle for controlling the steering direction of the hull 11 by the swinging operation of the steering handle 28 in the lateral direction.

The vessel 10 can be propelled by supplying fuel from the fuel tank 14 to the engine 15 to drive the engine 15, transmitting a driving force of the engine 15 to the impeller 22 via the drive shaft 23, drawing in water through the opening 13 of the vessel bottom 12 by rotating the impeller 22, and splashing the water through the rear end of the housing 21 from the steering nozzle 25.

Figure 2:
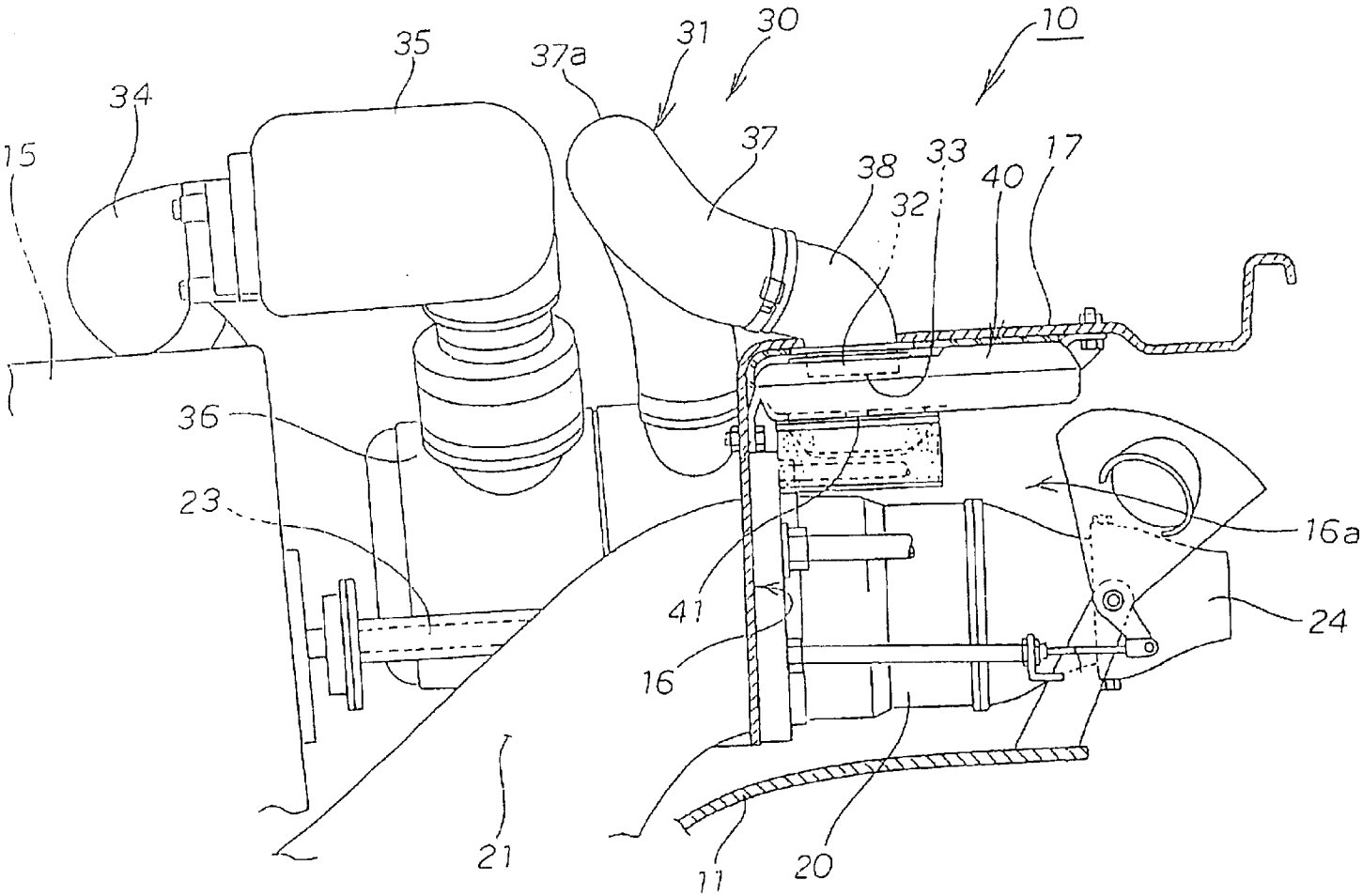
FIG. 2 is a side view of the exhaust system for a small boat according to the present invention.

FIG. 2 is a side view of the exhaust system for a small boat according to the present invention.

The exhaust system 30 for a small boat is such that an exhaust pipe 31 is connected to an exhaust manifold (not shown) of the engine 15. The end 32 of the exhaust pipe 31 is mounted along the top wall 17 (wall surface of the hull) of the pump chamber 16, a resonator 40 disposed on the top wall 17 is connected to the end 32 of the exhaust pipe 31, and the exhaust port 41 of the resonator 40 is faced toward the internal space 16*a* of the pump chamber 16.

Accordingly, the exhaust port 33 of the exhaust pipe 31 can communicate with the internal space 16*a* of the pump chamber 16 via the exhaust port 41 of the resonator 40. Exhaust gas and cooling water can be discharged from the exhaust port 41 of the resonator 40 smoothly by disposing the exhaust port 41 of the resonator 40 at the position facing toward the exhaust port 33 of the exhaust pipe 31.

The exhaust pipe 31 comprises an exhaust pipe 34 connected to the exhaust manifold, an exhaust body 35 connected to the exit of the exhaust pipe 34, a water muffler 36 connected to the exit side of the exhaust body 35, a water lock pipe 37 connected to the water muffler 36, and a tail pipe 38 connected to the exhaust port of the water lock pipe 37. The end 32 of the tail pipe 38 (cf. the end of the exhaust pipe 31) is attached to the top wall 17 of the pump chamber 16.

The water muffler 36 is a member disposed on the right side of the pump chamber 16. The water muffler 36 will be described in detail later referring to FIG. 3 to FIG. 7.

By disposing a resonator 40 in the internal space 16*a* of the pump chamber 16, the space originally left as a dead space therein may be used for mounting the resonator 40. Therefore, it is not necessary to secure a space for mounting the resonator 40 in the hull 11. The resonator 40 can be formed into a compact rectangular shape. This can be accomplished by forming the hollow portion communicating with the water lock pipe 37 in the meandering shape.

By providing such resonator 40, the principle of resonance can be used for attenuating the resonance of the water lock pipe 37.

The water lock pipe 37 is a pipe bent so that the convex portion 37*a* comes to the top. By disposing the convex portion 37*a* of the water lock pipe 37 on top, in the unlikely event that water has entered water lock pipe 37 from the tail pipe 38, the entered water is prevented from flowing over the convex portion 37*a* of the water lock pipe 37. Thereby water is prevented from entering into the engine 15 side. In other words, the water lock pipe 37 has a water locking capability.

Figure 3:
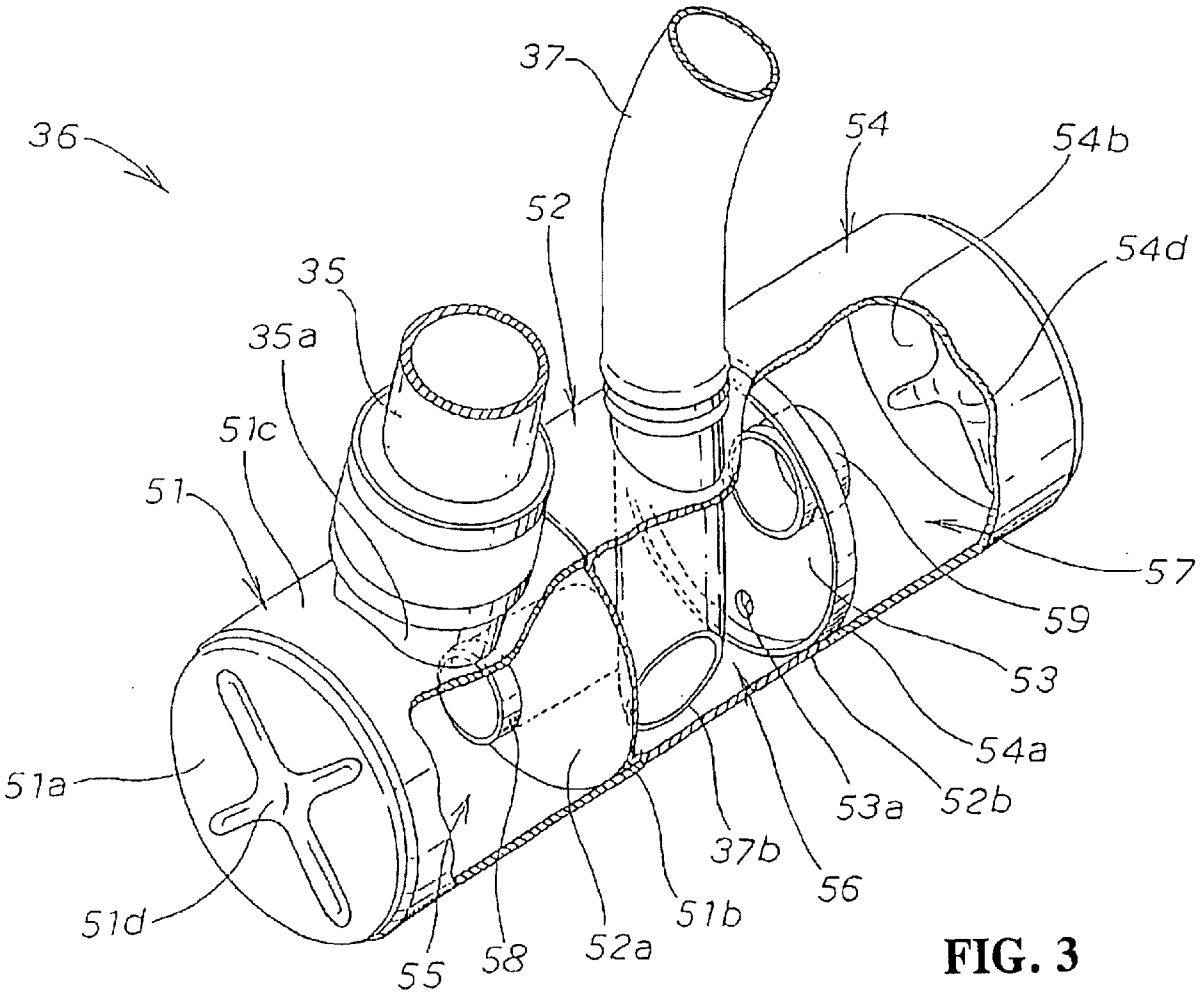
FIG. 3 is a perspective view showing a water muffler of the exhaust system for a small boat according to the present invention.

FIG. 3 is a perspective view showing a water muffler of the exhaust system for a small boat according to the present invention.

The water muffler 36 comprises a first cylindrical body 51 having a front cap 51*a* formed integrally therewith, a second cylindrical body 52 having a front wall surface 52*a* formed integrally therewith for closing the rear end opening 51*b* of the first cylindrical body 51, a rear wall surface 53 for closing the rear end opening 52*b* of the second cylindrical body 52, and a third cylindrical body 54 having a front end opening 54*a* attached to the rear wall surface 53 and the second cylindrical body 52 and having a rear cap 54*b* integrally formed therewith. The first cylindrical body 51 and the front wall surface 52*a* define a first expansion chamber 55, the second cylindrical body 52 and the rear wall surface 53 define a second expansion chamber 56, and the rear wall surface 53 and the third cylindrical body 54 define a resonator chamber 57.

In addition, the water muffler 36 is constructed in such a manner that the exit 35*a* of the exhaust body 35 is attached to the side wall 51*c* of the first cylindrical body 51, the front wall surface 52*a* is provided with a front communication pipe 58 enabling the first expansion chamber 55 and the second expansion chamber 56 to communicate with each other, and the inlet port 37*b* side of the water lock pipe 37 is attached on the side wall 52*c* of the second cylindrical body 52. The rear wall surface 53 is provided with a rear communication pipe (communication pipe) 59 enabling the second expansion chamber 56 and the resonator chamber 57 to communicate with each other, and the rear wall surface 53 is formed with a communication hole 53*a* enabling the second expansion chamber 56 and the resonator chamber 57 to communicate with each other.

The resonator chamber 57 is a sound box for attenuating resonant of the water lock pipe 37. The characteristics of the resonator chamber 57 can be determined by the volume of the resonator chamber (sound box) 57, the diameter of the front communication pipe 58, and the length of the front communication pipe 58.

Therefore, the volume of the resonator chamber (sound box) 57, the diameter of the front communication pipe 58, and the length of the front communication pipe 58 may be determined as appropriate so as to correspond with resonance of the water lock pipe 37.

The front cap 51*a* of the first cylindrical body 51 and the rear cap 54*b* of the third cylindrical body 54 are formed with substantially cross shaped recesses (hereinafter referred to as "reinforcing rib") 51*d*, 54*d* respectively. Since formation of the reinforcing ribs 51*d*, 54*d* can enhance the rigidity of the water muffler 36, vibration of the front cap 51*a* and the rear cap 54*b* can be suppressed.

Therefore, a so-called flattering sound can be prevented from being generated, and thus, the noise of the jet propulsion boat can be reduced.

Figure 4:
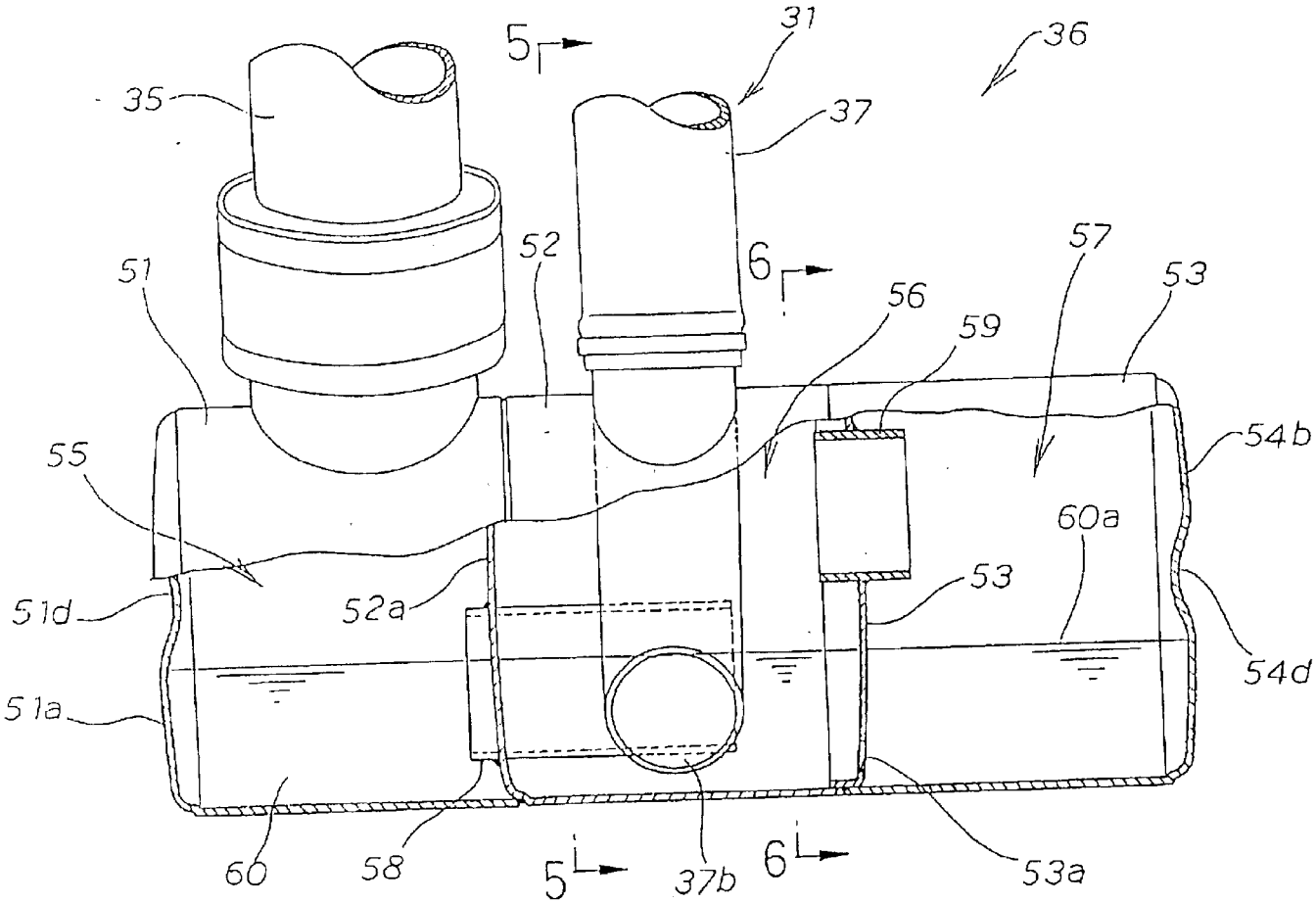
FIG. 4 is a cross sectional view showing the water muffler of the exhaust system for a small boat according to the present invention.

FIG. 4 is a cross sectional view showing a water muffler of the exhaust system for a small boat according to the present invention, showing a state in which a resonator chamber 57 for attenuating resonance of the water lock pipe 37 is provided in the water muffler 36.

By providing a resonator chamber 57 in the water muffler 36, it is not necessary to provide a resonator outside the exhaust pipe 31, and thus to secure a storing space for a resonator in the limited space in the hull 11 (shown in FIG. 1).

Therefore, the space in the hull 11 can be sufficiently utilized as a space for mounting various accessories required for a vessel, and thus, the layout of the various accessories required for a vessel can be determined relatively easily.

In addition, by forming a resonator chamber 57 by utilizing the water muffler 36, the number of the members for constituting the resonator may be reduced.

The second expansion chamber 56 and the resonator chamber 57 in the water muffler 36 can communicate with each other by means of a rear communication pipe 59. The rear communication pipe 59 is disposed above the water level of the cooling water 60 in the water muffler 36.

Therefore, since the rear communication pipe 59 is not closed by cooling water 60, the characteristics of the resonator chamber 57 can be maintained. Thus, the attenuation of resonance of the water lock pipe 37 is ensured.

Figure 5:
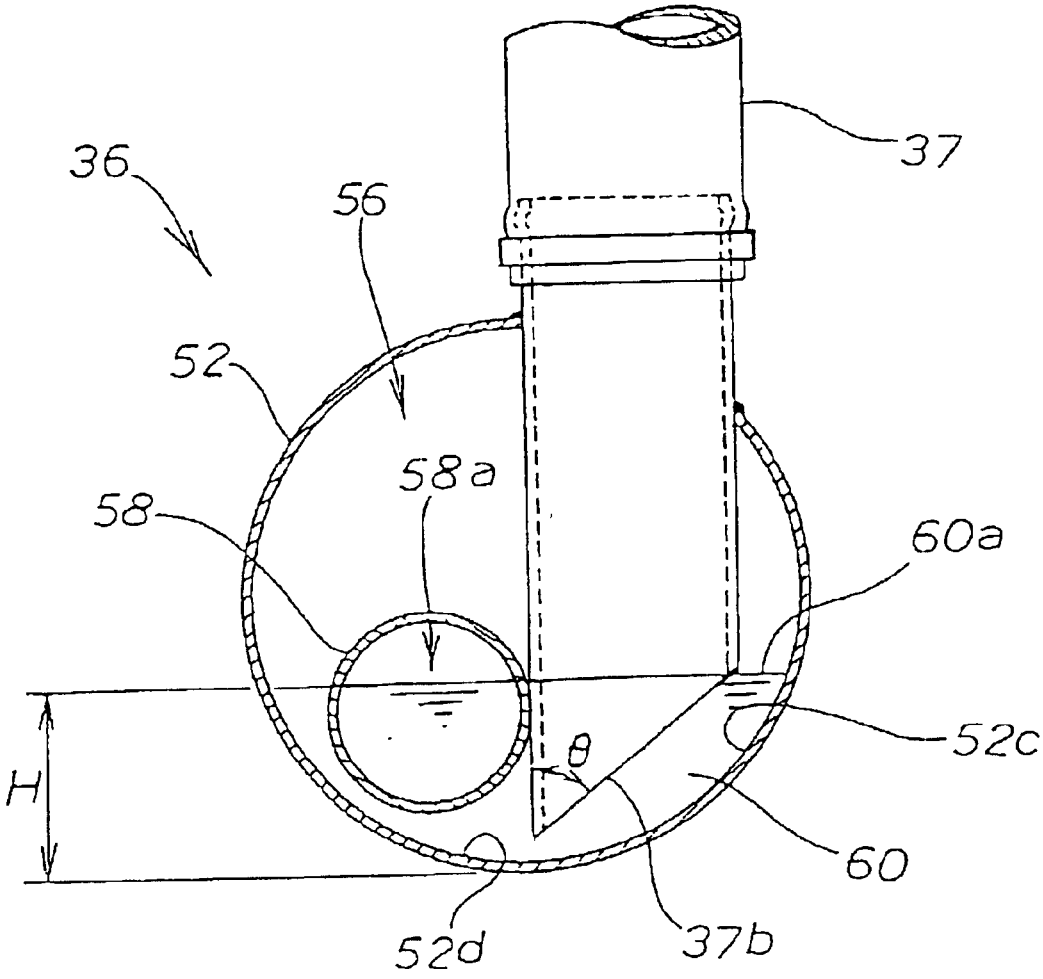
FIG. 5 is a cross sectional view taken along the line 5—5 in FIG. 4.

FIG. 5 is a cross sectional view taken along the line 5—5 in FIG. 4.

By forming the inlet port 37*b* of the water lock pipe 37 into the tapered shape at the angle θ, the inlet port 37*b* can be disposed near the side wall 52*c* of the second cylindrical body 52. Therefore, cooling water 60 trapped in the bottom 52*d* of the second expansion chamber 56 can be conducted to the inlet port 37*b* smoothly with exhaust gas and discharged out the hull 11 (shown in FIG. 1) effectively from the water lock pipe 37.

The upper limit of the water level of cooling water 60 trapped in the water muffler 36(the height of water surface 60*a*) is the maximum height H of the inlet port 37*b* of the water lock pipe 37.

Even when the water level of cooling water 60 reaches the upper limit of the height H, since the upper space 58*a* of the front communication pipe 58 is disposed above cooling water 60, the first expansion chamber 55 (shown in FIG. 4) and the second expansion chamber 56 are always able to communicate with each other.

Therefore, exhaust gas in the first expansion chamber 55 can flow through the front connection pipe 58 into the second expansion chamber 56.

Figure 6:
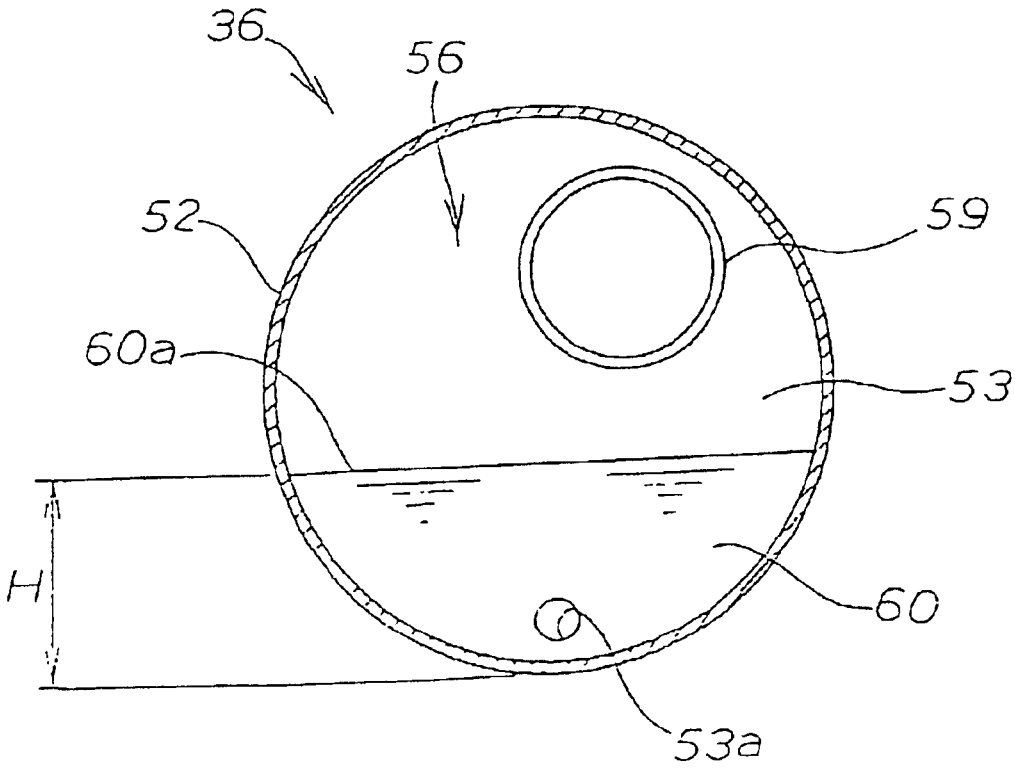
FIG. 6 is a cross sectional view taken along the line 6—6 in FIG. 4.

FIG. 6 is a cross sectional view taken along the line 6—6 in FIG. 4, showing a state in which the rear communication pipe 59 enable the second expansion chamber 56 and the resonator chamber 57 (shown in FIG. 4) in the water muffler 36 to communicate with each other. The rear communication pipe 59 is mounted at the upper position of the rear wall surface 53, and a communication hole 53*a* is formed at the lower portion of the rear wall surface 53.

By disposing the rear communication pipe 59 at the upper portion of the rear wall surface 53, the rear communication pipe 59 can be disposed at the position higher than the upper limit of the water level H of cooling water 60. Therefore, the rear communication pipe 59 is not closed by cooling water 60, and thus attenuation of resonant of the water lock pipe 37 is ensured while utilizing the principle of resonance in the resonator chamber 57.

Subsequently, the exhaust system 30 for a small boat, especially the operation of the water muffler 36, is described referring to FIG. 7.

Figure 7:
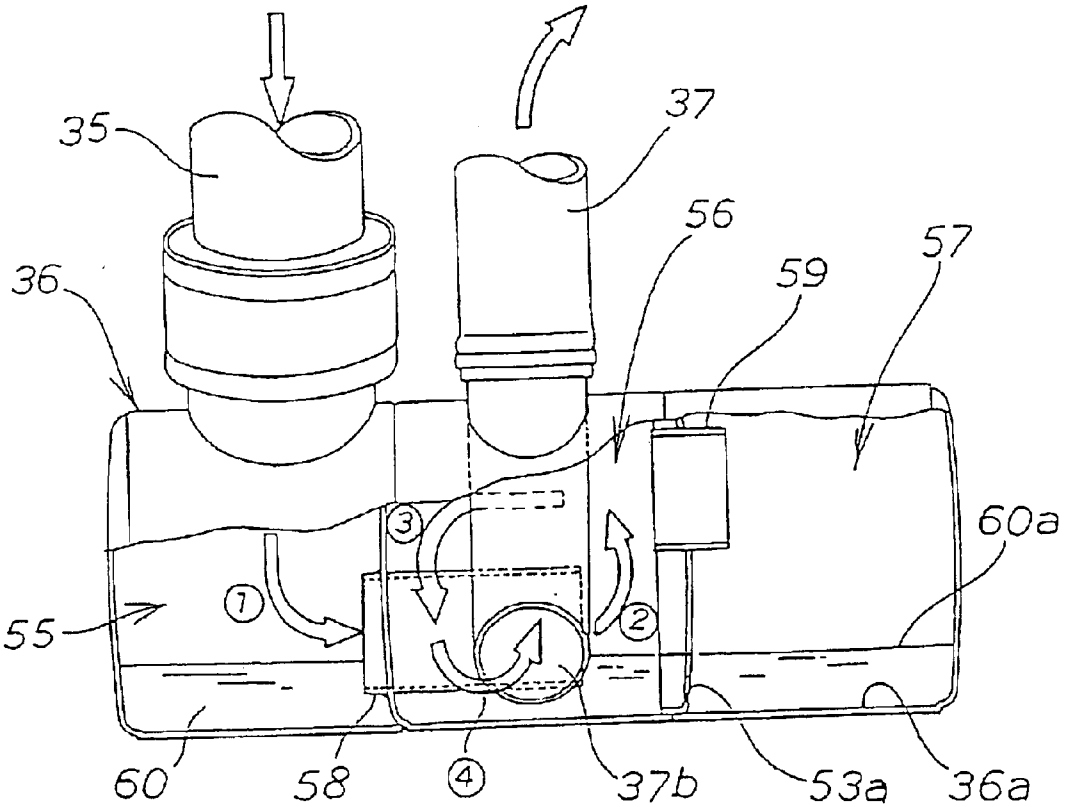
FIG. 7 is an explanatory drawing illustrating the operation of the water muffler constituting the exhaust system for a small boat according to the present invention.
Figure 8:
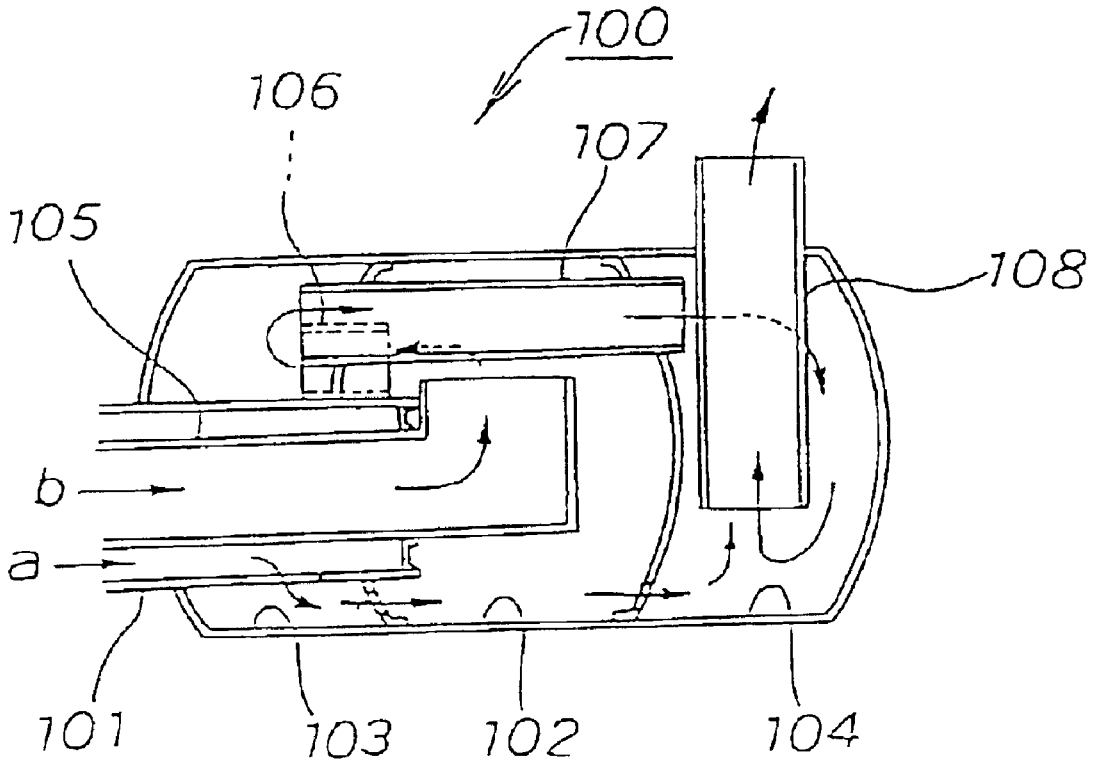
FIG. 8 is a cross sectional view showing a water muffler in the related art.

FIG. 7 is an explanatory drawing illustrating the operation of the water muffler constituting the exhaust system for a small boat according to the present invention.

Exhaust gas discharged from the engine 15 (shown in FIG. 2) flow through the exhaust pipe 34 (shown in FIG. 2) connected to the exhaust manifold (not shown) to the exhaust body 35, and then from the exhaust body 35 to the first expansion chamber 55 of the water muffler 36 as shown by the arrow (1).

On the other hand, a part of cooling water 60 used for cooling exhaust gas also flows through the exhaust body 35 into the first expansion chamber 55 of the water muffler 36.

Exhaust gas from the first expansion chamber 55 flows through the front communication pipe 58 to the second expansion chamber 56 as shown by the arrow (2), and exhaust gas from the second expansion chamber 56 circulates in the second expansion chamber 56 as shown by the arrow (3).

Circulated exhaust gas flows from the inlet port 37*b* of the water lock pipe 37 into the water lock pipe 37 as shown by the arrow (4), and is discharged from water lock pipe 37 to the outside of the hull 11 (shown in FIG. 1).

Since the second expansion chamber 56 and the resonator chamber 57 are able to communicate with each other by means of the rear communication pipe 59, attenuation of resonance of the water lock pipe 37 is ensured while utilizing the principle of resonance of the resonator chamber 57. Thus, the sound-deadening effect of exhaust noise can be enhanced sufficiently.

On the other hand, cooling water 60 from the first expansion chamber 55 flows through the front communication pipe 58 into the second expansion chamber 56, and cooling water 60 in the second expansion chamber 56 flows through the communication hole 53*a* into the resonator chamber 57.

As a consequence, cooling water 60 is retained in the entire area of the bottom surface 36*a* of the water muffler 36. The retained cooling water 60 flows with exhaust gas through the inlet port 37*b* of the water lock pipe 37 into the water lock pipe 37, and then from the water lock pipe 37 to the outside of the hull 11.

Though an example in which the resonator chamber 57 is provided in the water muffler 36 and the end 32 of the exhaust pipe 31 is provided with a resonator 40 has been described in the aforementioned embodiment, it is not limited thereto. For example, it is possible to eliminate the resonator 40, and provide only the resonator chamber 57 in the water muffler 36.

Further, though a jet propulsion boat that is propelled by a jet pump is taken as an example of small boats for description in the aforementioned embodiment, propelling means for a small boat is not limited thereto.

In addition, though an example in which the water muffler 36 comprises the first and the second expansion chambers 55, 56 has been described in the aforementioned embodiment, it is not limited thereto. It is possible to determine the number of the expansion chamber arbitrarily. The configuration of the water muffler 36 can be changed as appropriate.

With this construction the present invention exerts the following effects.

According to the first aspect of the present invention, since the resonator chamber for attenuating resonant of the water lock pipe is provided in the water muffler, it is not necessary to secure the storing space for the resonator in the limited space in the hull. Therefore, the space in the hull can be utilized primarily as a space for mounting various accessories required for a vessel. Thus the layout of such various accessories required for a vessel can be determined relatively easily.

Therefore, since the resonator can be provided relatively easily, exhaust noise can be reduced easily.

In addition, by forming the resonator chamber using the water muffler, the number of the members for constituting the resonator can be reduced. This enables a reduction in cost.

According to the second aspect of the present invention, the communication pipe enabling the expansion chamber and the resonator chamber to communicate with each other is disposed above the water level in the water muffler. Therefore, the communication pipe is not closed by cooling water, and thus, the expansion chamber and the resonator chamber are able to communicate continuously.

Therefore, since the characteristics of the resonator chamber can be maintained, the capability of resonator chamber to attenuate the resonance of the water lock pipe can be maintained as well. Therefore, reduction of exhaust noise of exhaust gas is ensured.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust system for a boat comprising:

a cylindrical-shaped water muffler disposed rearwardly from an engine provided in a hull of the boat; and a water lock pipe having an inverted U-shape extending upward from a side of said cylindrical-shaped water muffler for discharging exhaust gas out of the boat, wherein a resonator chamber for attenuating resonance of the water lock pipe is provided in the water muffler.

2. The exhaust system for a boat according to claim 1, further comprising an expansion chamber in the water muffler, wherein the expansion chamber and the resonator chamber are able to communicate with each other by a communication pipe, said communication pipe being disposed above an upper surface of cooling water in the water muffler.

3. The exhaust system for a boat according to claim 2, wherein the water lock pipe includes an inlet port having an opening at a predetermined angle from a horizontal direction, said water lock pipe extending upward from the expansion chamber of the muffler.

4. The exhaust system for a boat according to claim 1, said water muffler comprising:

a first cylindrical body having a front cap, said first cylindrical body having a first expansion chamber contained therein;

a second cylindrical body having a front wall surface formed integrally therewith for closing the rear end opening of the first cylindrical body, and a rear wall surface for closing the rear end opening of the second cylindrical body, said second cylindrical body having a second expansion chamber contained therein; and a third cylindrical body having a front end opening attached to the rear wall surface of the second cylindrical body and having a rear cap integrally formed therewith, said third cylindrical body having a resonator chamber contained therein.

5. The exhaust system for a boat according to claim 4, wherein the water lock pipe includes an inlet port having a tapered shape at a predetermined angle, said water lock pipe extending upward from the second expansion chamber of the muffler.

6. The exhaust system for a boat according to claim 4, wherein said front cap and said rear cap are each formed with reinforcing ribs for suppressing vibration of the muffler.

7. The exhaust system for a boat according to claim 4, wherein a first communication pipe allows a cooling water to flow between said first expansion chamber and said second expansion chamber, and a communications hole allows said cooling water to flow between said second expansion chamber and said resonator chamber, so that said cooling water is retained in an entire area of a bottom surface of the water muffler.

8. The exhaust system for a boat according to claim 2, wherein the water muffler includes a communication hole between the expansion chamber and the resonator chamber for allowing said cooling water to flow between the expansion chamber and the resonator chamber.

9. The exhaust system for a boat according to claim 2, wherein a downstream end of the water lock pipe is connected to a resonator through a tail pipe.

10. An exhaust system for a boat comprising:

a tube-shaped water muffler having an axis aligned parallel to a length of the boat, the water muffler being disposed between two sections of an exhaust pipe and rearwardly from an engine provided in a hull of the boat; and a water lock pipe having an inverted U-shape extending upward from a middle portion of said water muffler for discharging exhaust gas out of the boat, wherein a resonator chamber for attenuating resonance of the water lock pipe is provided in the water muffler.

11. The exhaust system for a boat according to claim 10, further comprising an expansion chamber in the water muffler, wherein the expansion chamber and the resonator chamber are able to communicate with each other by a communication pipe, said communication pipe being disposed above an upper surface of cooling water in the water muffler.

12. The exhaust system for a boat according to claim 11, wherein the water lock pipe includes an inlet port having an opening at a predetermined angle from a horizontal direction, said water lock pipe extending upward from the expansion chamber of the muffler.

13. The exhaust system for a boat according to claim 10, said water muffler comprising:

a first cylindrical body having a front cap, said first cylindrical body having first expansion chamber contained therein;

a second cylindrical body having a front wall surface formed integrally therewith for closing the rear end opening of the first cylindrical body, and a rear wall surface for closing the rear end opening of the second cylindrical body, said second cylindrical body having a second expansion chamber contained therein; and a third cylindrical body having a front end opening attached to the rear wall surface of the second cylindrical body and having a rear cap integrally formed therewith, said third cylindrical body having a resonator chamber contained therein.

14. The exhaust system for a boat according to claim 13, wherein the water lock pipe includes an inlet port having a tapered shape at a predetermined angle, said water lock pipe extending upward from the second expansion chamber of the muffler.

15. The exhaust system for a boat according to claim 13, wherein said front cap and said rear cap are each formed with reinforcing ribs for suppressing vibration of the muffler.

16. The exhaust system for a boat according to claim 13, wherein a first communication pipe allows a cooling water to flow between said first expansion chamber and said second expansion chamber, and a communications hole allows said cooling water to flow between said second expansion chamber and said resonator chamber, so that said cooling water is retained in an entire area of a bottom surface of the water muffler.

17. The exhaust system for a boat according to claim 11, wherein the water muffler includes a communication hole between the expansion chamber and the resonator chamber for allowing said cooling water to flow between the expansion chamber and the resonator chamber.

18. The exhaust system for a boat according to claim 11, wherein a downstream end of the water lock pipe is connected to a resonator through a tail pipe.

* * * * *